US008528246B2

(12) United States Patent
Telles

(10) Patent No.: US 8,528,246 B2
(45) Date of Patent: Sep. 10, 2013

(54) FORWARD HAND GUARD ASSEMBLY FOR RIFLE

(75) Inventor: Matthew Telles, Burke, VA (US)

(73) Assignee: Robert Saurman, Huntington Beach, CA (US)

( * ) Notice: Subject to any disclaimer, the term of this patent is extended or adjusted under 35 U.S.C. 154(b) by 0 days.

(21) Appl. No.: 13/447,670

(22) Filed: Apr. 16, 2012

(65) Prior Publication Data

US 2013/0019513 A1 Jan. 24, 2013

Related U.S. Application Data

(60) Provisional application No. 61/510,716, filed on Jul. 22, 2011.

(51) Int. Cl.
*F41C 23/16* (2006.01)

(52) U.S. Cl.
USPC ..... 42/94; 42/71.01; 42/85

(58) Field of Classification Search
USPC ..... 42/71.01, 72, 85, 94; 89/191.01–191.02, 89/14.1
See application file for complete search history.

(56) References Cited

U.S. PATENT DOCUMENTS

| | | | | |
|---|---|---|---|---|
| 3,090,150 | A * | 5/1963 | Stoner | 42/71.01 |
| 5,343,650 | A * | 9/1994 | Swan | 42/117 |
| 6,490,822 | B1 * | 12/2002 | Swan | 42/71.01 |
| 6,499,245 | B1 * | 12/2002 | Swan | 42/71.01 |
| 6,508,027 | B1 * | 1/2003 | Kim | 42/124 |
| 6,775,942 | B2 * | 8/2004 | Compton | 42/85 |
| 6,925,744 | B2 | 8/2005 | Kincel | |
| 7,059,076 | B2 | 6/2006 | Stoner et al. | |
| RE39,465 | E * | 1/2007 | Swan | 42/71.01 |
| 7,216,451 | B1 | 5/2007 | Troy | |
| D544,564 | S | 6/2007 | Swan | |
| RE40,216 | E * | 4/2008 | Swan | 42/71.01 |
| 7,363,740 | B2 | 4/2008 | Kincel | |
| 7,363,741 | B2 | 4/2008 | DeSomma | |
| 7,458,179 | B2 | 12/2008 | Swan | |
| 7,523,580 | B1 * | 4/2009 | Tankersley | 42/71.01 |
| 7,584,567 | B1 | 9/2009 | DeSomma et al. | |
| 7,793,452 | B1 * | 9/2010 | Samson et al. | 42/72 |
| 8,141,285 | B2 * | 3/2012 | Brown | 42/71.01 |
| 8,141,289 | B2 * | 3/2012 | Gomez et al. | 42/90 |
| 8,191,300 | B2 * | 6/2012 | Daniel | 42/71.01 |
| 8,201,353 | B1 * | 6/2012 | Swan | 42/71.01 |
| 8,276,304 | B2 * | 10/2012 | Samson et al. | 42/75.02 |
| 8,336,243 | B2 * | 12/2012 | Langevin et al. | 42/71.01 |
| 8,429,845 | B1 * | 4/2013 | Swan | 42/90 |
| 2006/0260169 | A1 * | 11/2006 | Samson et al. | 42/72 |
| 2007/0033851 | A1 * | 2/2007 | Hochstrate et al. | 42/75.01 |
| 2007/0261285 | A1 * | 11/2007 | Troy | 42/75.03 |
| 2008/0301994 | A1 * | 12/2008 | Langevin et al. | 42/71.01 |
| 2009/0178325 | A1 * | 7/2009 | Veilleux | 42/117 |
| 2010/0269392 | A1 * | 10/2010 | Swan | 42/71.01 |
| 2011/0107643 | A1 * | 5/2011 | Fitzpatrick et al. | 42/72 |
| 2011/0192066 | A1 * | 8/2011 | Kimmel et al. | 42/71.01 |
| 2012/0124880 | A1 * | 5/2012 | Leclair | 42/71.01 |
| 2012/0132068 | A1 * | 5/2012 | Kucynko | 89/191.01 |
| 2012/0180359 | A1 * | 7/2012 | Fitzpatrick et al. | 42/71.01 |
| 2012/0317859 | A1 * | 12/2012 | Brown | 42/71.01 |
| 2013/0036646 | A1 * | 2/2013 | Rubac et al. | 42/90 |

* cited by examiner

*Primary Examiner* — Bret Hayes
*Assistant Examiner* — Joshua Freeman
(74) *Attorney, Agent, or Firm* — Shoemaker and Mattare

(57) ABSTRACT

A forward hand guard assembly for a rifle includes an upper metal hand guard which is secured to the receiver rifle by a clamp, and a lower grip which is releasably secured to the upper guard and the clamp by a latching pin. The clamp has a locking mechanism which can be released without tools. The grip is a molded plastic body designed to rest comfortably in the hand.

24 Claims, 12 Drawing Sheets

FORWARD HAND GUARD ASSEMBLY FOR RIFLE

This application claims benefit of provisional application 61/510716, filed Jul. 22, 2011.

BACKGROUND OF THE INVENTION

This invention relates to a forward hand guard assembly for a semiautomatic rifle, such as the AR-15 rifle illustrated in FIG. 1.

The polymer forward hand guards or "forearms" provided as original equipment on many rifles are of large diameter and tubular in design requiring that the shooter's hand be wrapped around the guard (substantially beyond 50% of the circumference of the tube, as shown in FIG. 3*b*) to get a secure grip. Gripping a large diameter forearm this way is not ergonomic; it tires the hand and lower arm, which results in a poor grip and muscular fatigue. FIGS. 2*b* and 2*c* illustrate that the human hand is better suited to grip small diameter cylindrical objects where the fingers and hand can wrap fully around the diameter of the cylinder (locking the cylinder between the fingers and palm); while FIG. 2*a* shows the hand in an even more ideal position in the fully relaxed open position. FIG. 3*a* shows a handgrip according to the present invention: the hand is relaxed, in a configuration more like that of FIG. 2*a*.

Unlike hunting or other military rifles which use a full stock, many semiautomatic rifles use three separate primary human interface points for stability, control and operation: the butt stock, the grip and the forward hand guard. The butt stock is used to ground the weapon against the body of the shooter, providing a point of stability; it also transfers recoil away from the weapon. The grip, sometimes referred to as a pistol grip, is a second point of control and stability for the weapon, and optimally positioning the shooter's trigger finger near to the weapon's operational controls. The forward hand guard serves as the third interface between the shooter and the weapon and is a primary point of support and control for weapon aiming.

The forward hand guard provides the main point of support for stabilizing the weapon by the shooter, allowing for accurate aiming and firing. Thus the hand and arm that interact with the forward hand guard are often referred to as the "support side" of the shooter, while the trigger hand is referred to as the strong or dominant side.

When a rifle is raised to the dominant side shoulder and aimed perpendicular to the shooter's body, the weight of the elevated stock, action or receiver, and barrel creates a cantilever effect, requiring a brace to counteract the weight and to stabilize the front of the weapon. The shooter's support side arm, with elbow bent and hand gripping the underside of the forward hand guard create the triangular brace needed to help transfer the outward extending weapon weight back to the shooter's body. Bracing the weapon in this manner also provides another point of stability for the weapon.

The act of extending the arm and hand out away from the body to support the weight of the rifle by gripping the forward hand guard, places physical demands on the shooter's anatomy. When the shooter is standing erect, the stability of the rifle becomes a function of a shooter's physical conditioning, technique, and comfort or ability to relax. Failure in any of these areas results in muscular fatigue, which commonly manifests itself through discomfort and shaking or quivering. Such movement is transferred to the rifle and compromises accuracy.

The fatigue created by the extension in arm and hand results in shaking or quivering of the muscles and causes movements in the weapon's barrel and sights, compromising accuracy.

The AR-15 rifle, M4 carbine, M16, AR-10 and like semiautomatic rifles share many common features and are all weapons that utilize the three separate primary human interface points described above. Because of the similarities in design and for the ease of this discussion we refer to this group of rifles simply as AR-15 rifles hereafter.

In the case of AR-15 type rifles, most are factory-equipped with one of three front hand guard designs: the traditional circular or oval polymer forward hand guard, an elongated tubular aluminum hand guard, or what is commonly referred to as an aluminum quad-rail hand guard. The purpose of these hand guards is (a) to provide a gripping surface for the shooter to secure the rifle, (b) to protect the forward hand from heat radiated from the barrel, and (c) to protect the operating components of the rifle. One feature that nearly all of these forward hand guards have in common is that they are all designed to be centered about the center of the rifle barrel's bore or center line.

A second common feature of many of these designs is that they all seek to maintain proper thermal clearances away from the hot barrel resulting in relatively large diameter profiles.

The fact that most forward hand guards are centered around the barrel's bore means that their widest points correspond with the two outer most surfaces of the barrel (i.e., three and nine o'clock positions). To maintain consistent insulating properties of the guard, the bottom of the guard or the six o'clock position is at least as far from the center of the barrel as at the three and nine o'clock positions. The combination of side width and the depth between the center of the barrel and the lowest point of the guard's profile require a deep grasp in order to properly secure the rifle with the support hand.

To grip these hand guards with a secure grip, the shooter must rest the bottom of the hand guard in the palm, while extending and wrapping fingers up and around the guard's large circumference. To achieve a secure grip, the ball of the shooter's finger tips must extend beyond 50% of the guard's circumference. The area above the 50% circumference can be referred to as the control surface area. It is this area that the fingers pull down against, capturing the guard between themselves and the palm. With the fingers positioned in this manner, having crossed beyond the 50% threshold, the forward hand sufficiently envelops the guard to provide a secure or locking grip. A locking grip is established when the fingers are able to pull an object in toward the palm. Conversely, if a shooter grips such guards over less than 50% of the circumference, with sufficient force, the guard will have a tendency to pop up out of the grasp of the shooter. This phenomenon is similar to what happens when one pinches a golf ball or other similar round object over less than 50% of the circumference. In such situations more force, only increases the likelihood of the guard jumping.

In addition to the general deep grasp problem described previously, aluminum quad rail guards are also hampered by the sharply machined "picatinny" accessory mounting rails that are machined into their side and bottom profiles. The harshness of the machined surfaces has resulted in manufacturers and aftermarket providers creating many after-the-fact solutions, the most common of which is the application of external covers that are meant to insulate the shooter's hand and to provide a smoother surface to grasp. The consequence to all these designs is that they all add even more circumference around which a shooter's hand must reach, further compounding the deep grasp problem.

Although physical conditioning and shooting technique are unique to each shooter, comfort can be directly influenced through proper ergonomic hand guard design.

The ideal hand guard design would provide a shallow grip, allowing for a relaxed hand and a positive gripping control edge to allow for a strong yet comfortable secure grip. These two ideal characteristics would be achieved by lowering the center of the guard's control surfaces from the barrel's center line, so that the guard is not constrained to the default widths and would also provide the room necessary to incorporate control edges for increased gripping.

The shallow grip used in an ideal hand guard profile would enable the shooter's hand to relax into a natural position. The universal natural position of a hand is a flat palm, semi-erect thumb and half-bent fingers. By incorporating a guard profile that allows for a relaxed natural hand position the stress on a shooter's forearm and hand is greatly reduced. Secondly, the ideal design would utilize well-defined, finite control edges as part of the shallow profile allowing the shooter to expend the minimum energy possible to maintain control of the weapon.

Because shooters and shooting conditions vary widely from one situation to the next, the ideal design would include various situation-specific hand grip profiles, and would allow these hand grip profiles to be quickly interchanged without the need for tools while in the field. Furthermore the tool-less assembly locking mechanism would provide a robust, secure function.

By creating a forward hand guard profile that allows the hand to relax and assume a natural position combined with control edges for an optimal secure grasp, a shooter will experience less fatigue and will allow for steadier and longer holds of the rifle.

It would improve the accuracy of a firearm, and the comfort of the shooter, to provide an ergonomic forward hard guard that overcame the problems mentioned above.

SUMMARY OF THE INVENTION

An object of the invention is to optimize the interface between the rifle and its shooter, in particular by providing a hand guard assembly having a replaceable lower grip portion which can be chosen for its ergonomic compatibility with a particular person's anatomy, stance, and shooting environment or situation, while maintaining the utility of readily mountable accessories.

These and other objects are attained by a forward hand guard assembly for a rifle, as described below.

The hand guard assembly includes an upper metal portion which provides structural strength and a lower ergonomic grip portion which permits a shallower grip and enables one to support the rifle with a relaxed hand.

The terms "longitudinal", "transverse", "horizontal" and "vertical" are use below to indicate directions relative to the rifle, if held normally and pointed in a horizontal direction. "Longitudinal" means along or parallel to the axis of the rifle barrel. "Transverse" means in a horizontal direction perpendicular to longitudinal. "Lengthwise" means in a longitudinal direction.

BRIEF DESCRIPTION OF THE DRAWINGS

In the accompanying drawings.

DESCRIPTION OF THE PREFERRED EMBODIMENT

Figure 1:
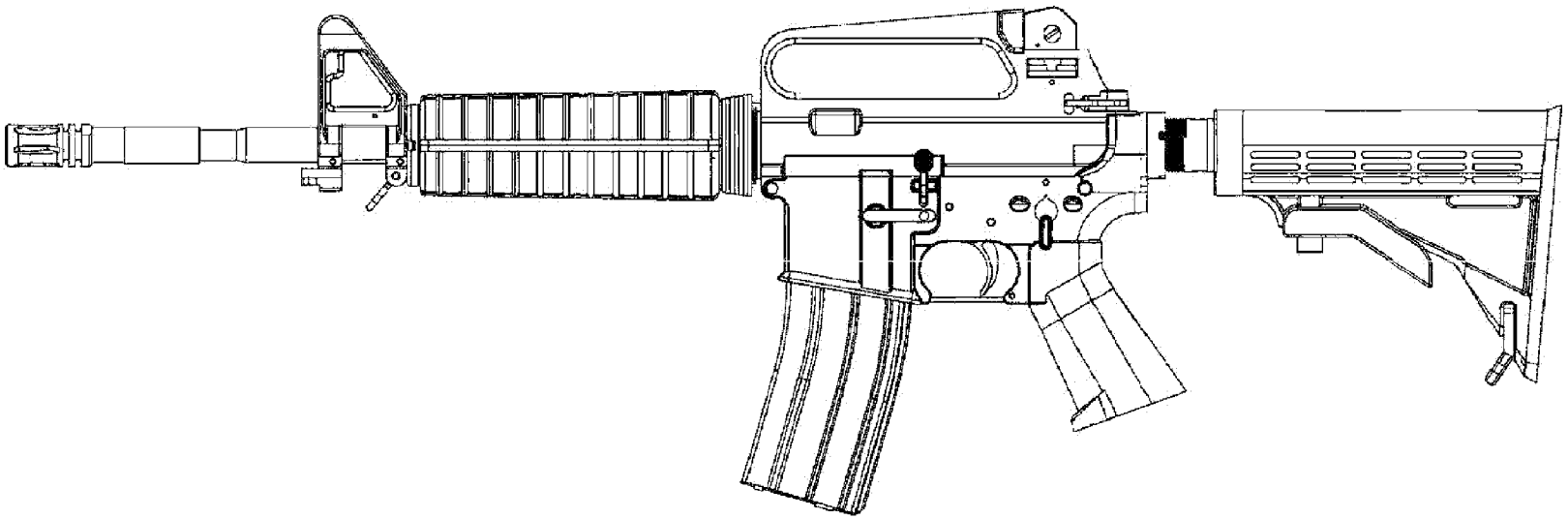
Fig. 1 (PRIOR ART)
FIG. 1 is a side view of an AR-15 rifle, with a standard front hand guard.
Figure 2C:
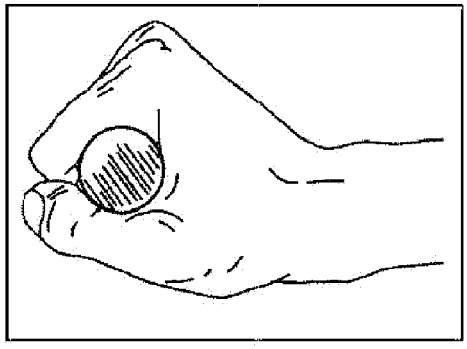
FIGS. 2*b* and 2*c* shows the hand tightly gripping a cylindrical object.
Figure 2B:
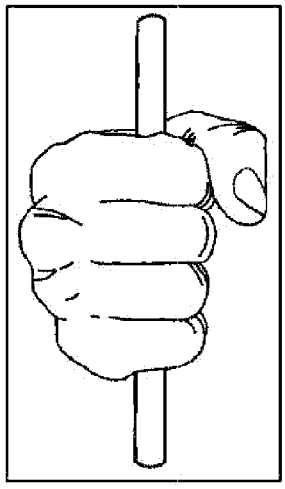
Figure 2A:
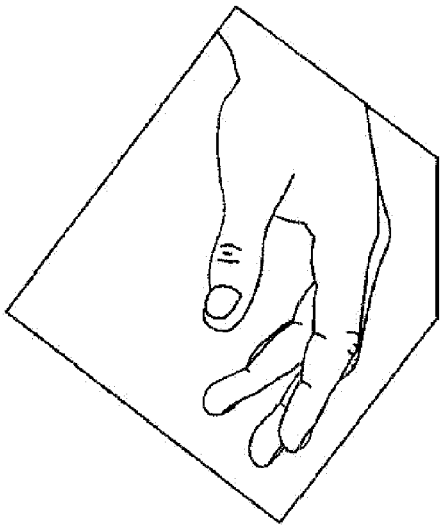
FIG. 2*a* depicts a relaxed outstretched hand.
Figure 3:
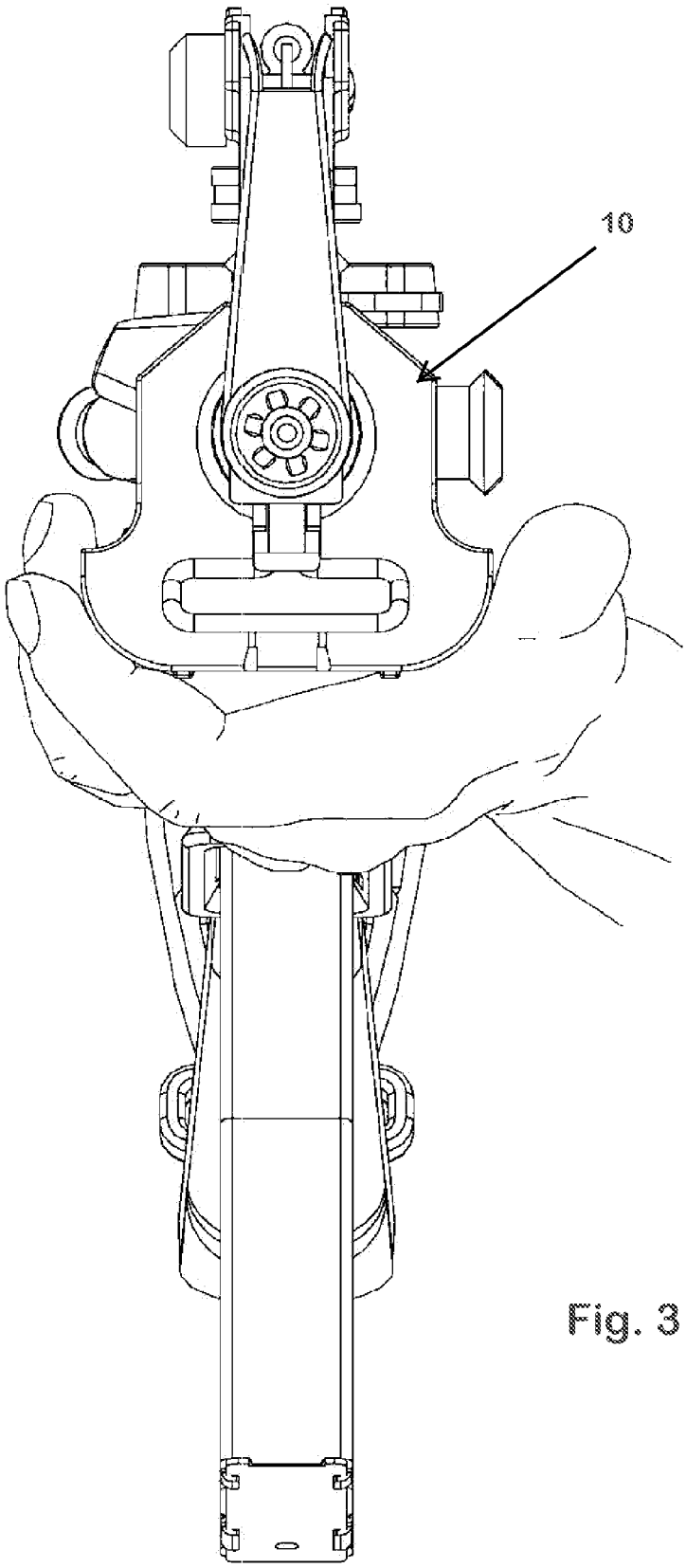
FIGS. 3 and 4 show the hand configuration when holding a rifle equipped according to the present invention, and according to conventional practice, respectively.
Figure 4:
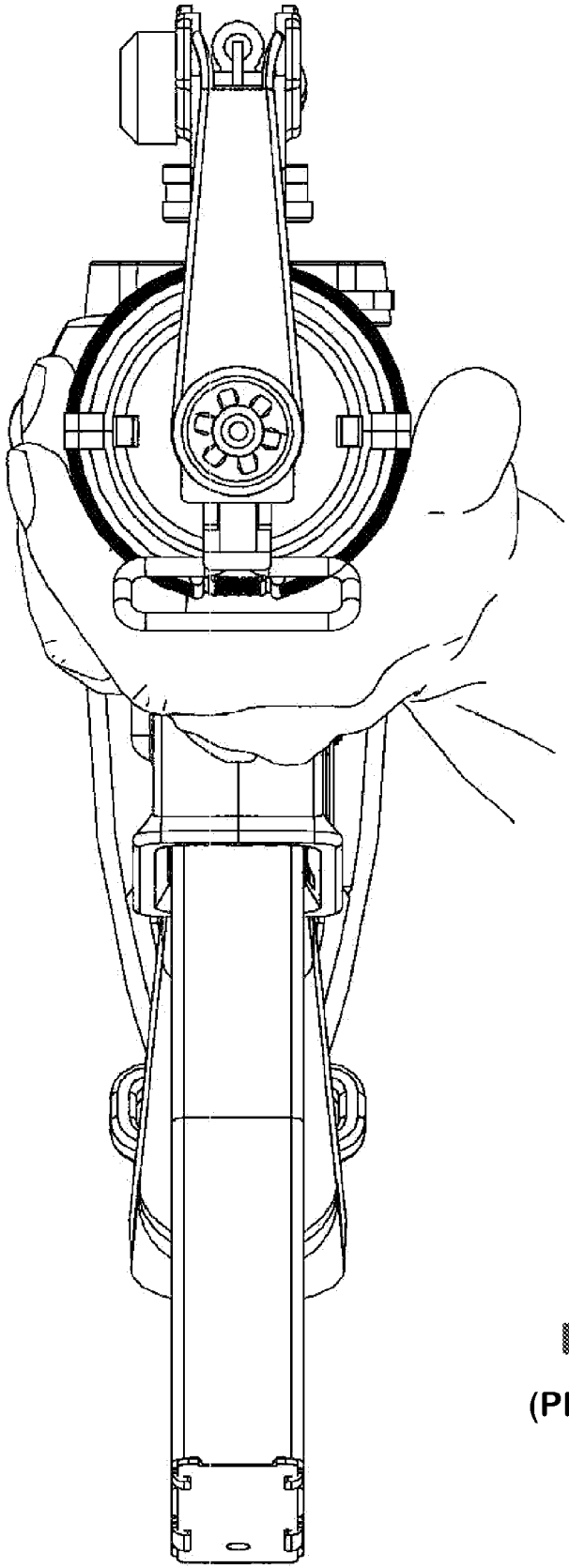
Fig. 4 (PRIOR ART)
Figure 5:
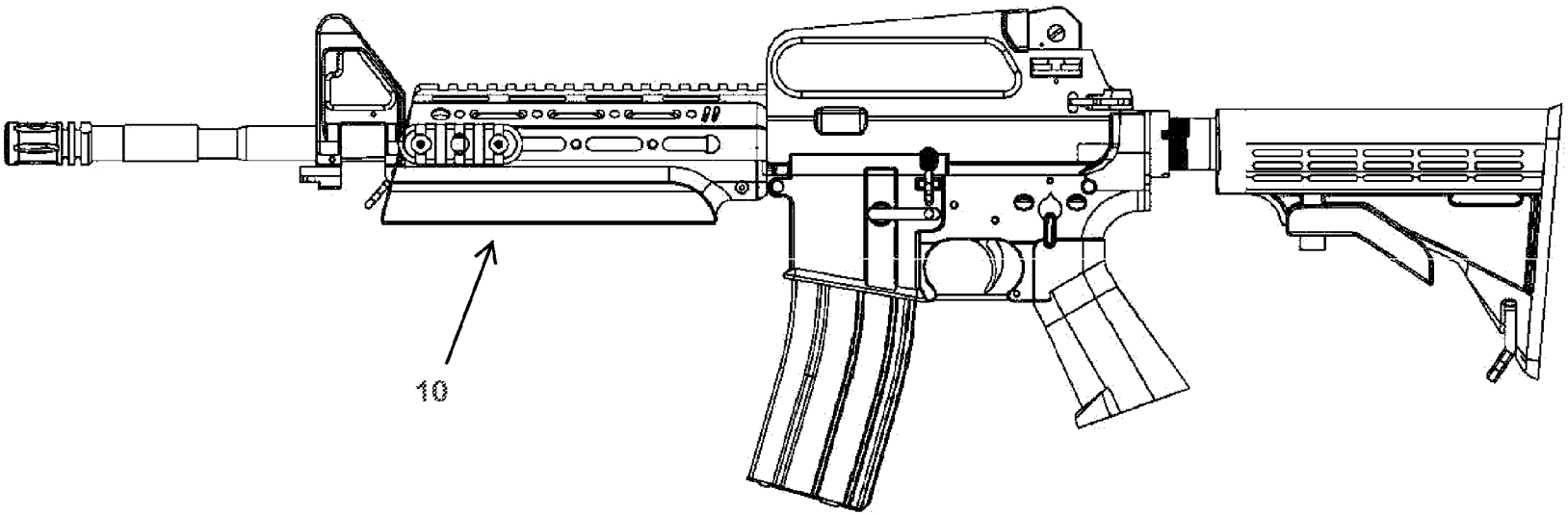
FIG. 5 shows a forward hand guard assembly embodying the invention, mounted on a rifle.
Figure 6:
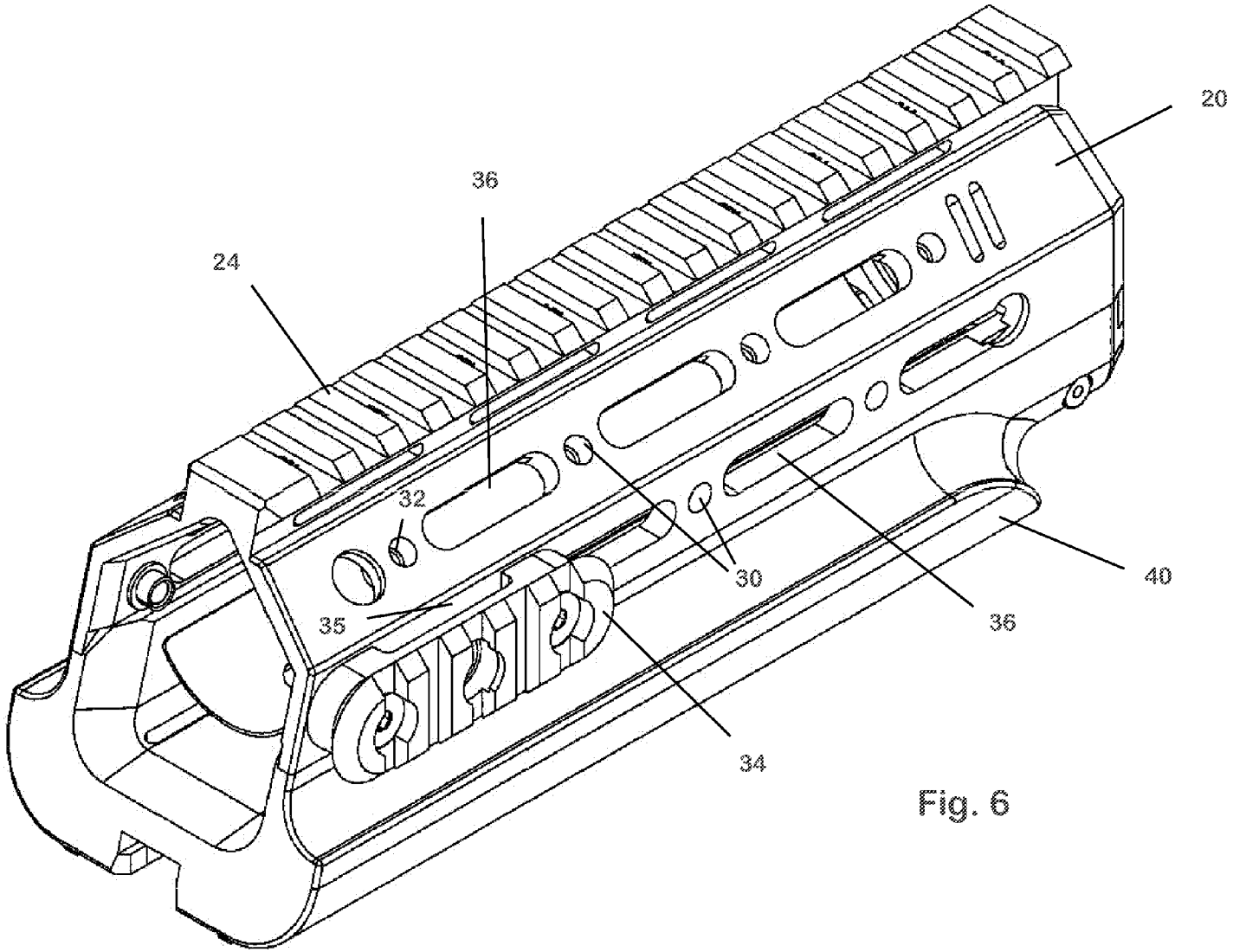
FIG. 6 is a perspective view of the hand guard.
Figure 7:
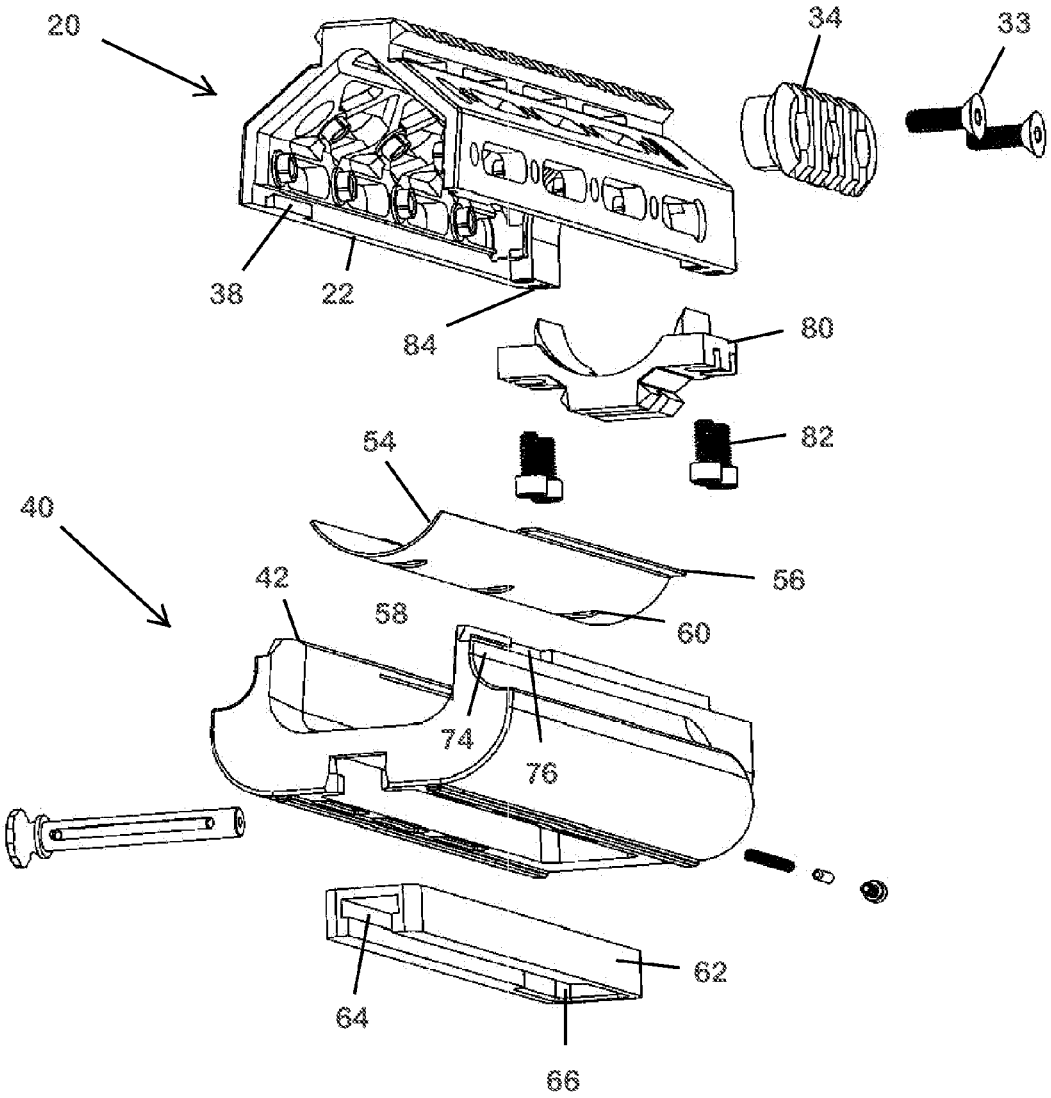
FIG. 7 is an exploded perspective view thereof from the front, left side, and below.
Figure 8:
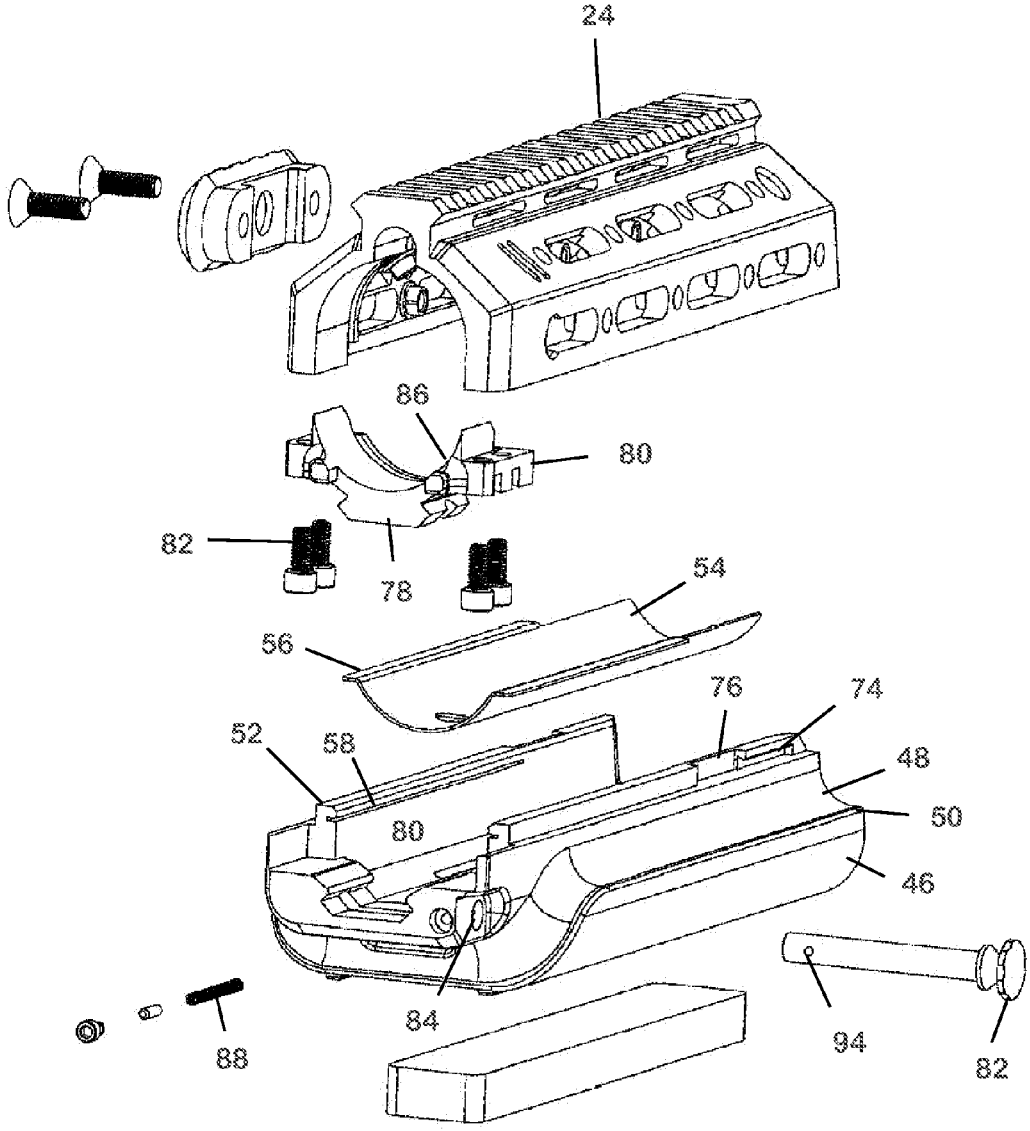
FIG. 8 is an exploded perspective view thereof from the rear, right side, and above.
Figure 9:
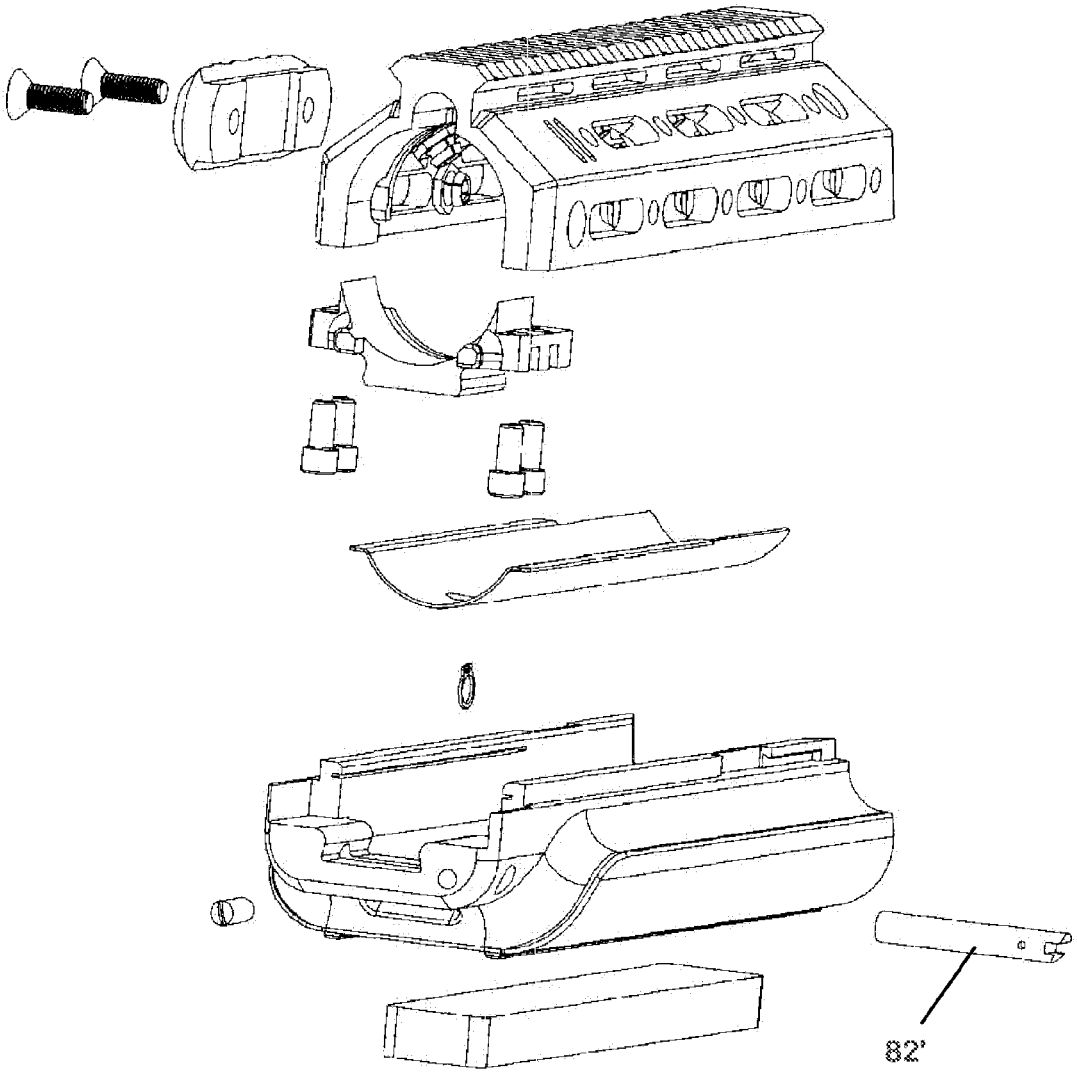
FIG. 9 is an exploded perspective view of a first modified form of the hand guard.

A forward hand guard assembly embodying the invention is designated by reference 10 in FIG. 3, where it is shown positioned for mounting over the barrel of a rifle. Some firearms have a sight post at the end of or along the barrel which is too large for the assembly to fit over; therefore, the device is made in two halves which can be assembled around the barrel.

Referring to FIGS. 6-10, the two major components of the assembly are an upper metal portion 20 and a lower hand grip 40. The parts have mating surfaces 22, 42 (FIG. 7) which meet at a plane containing, or closely parallel to, the axis of the gun barrel.

Figure 10:
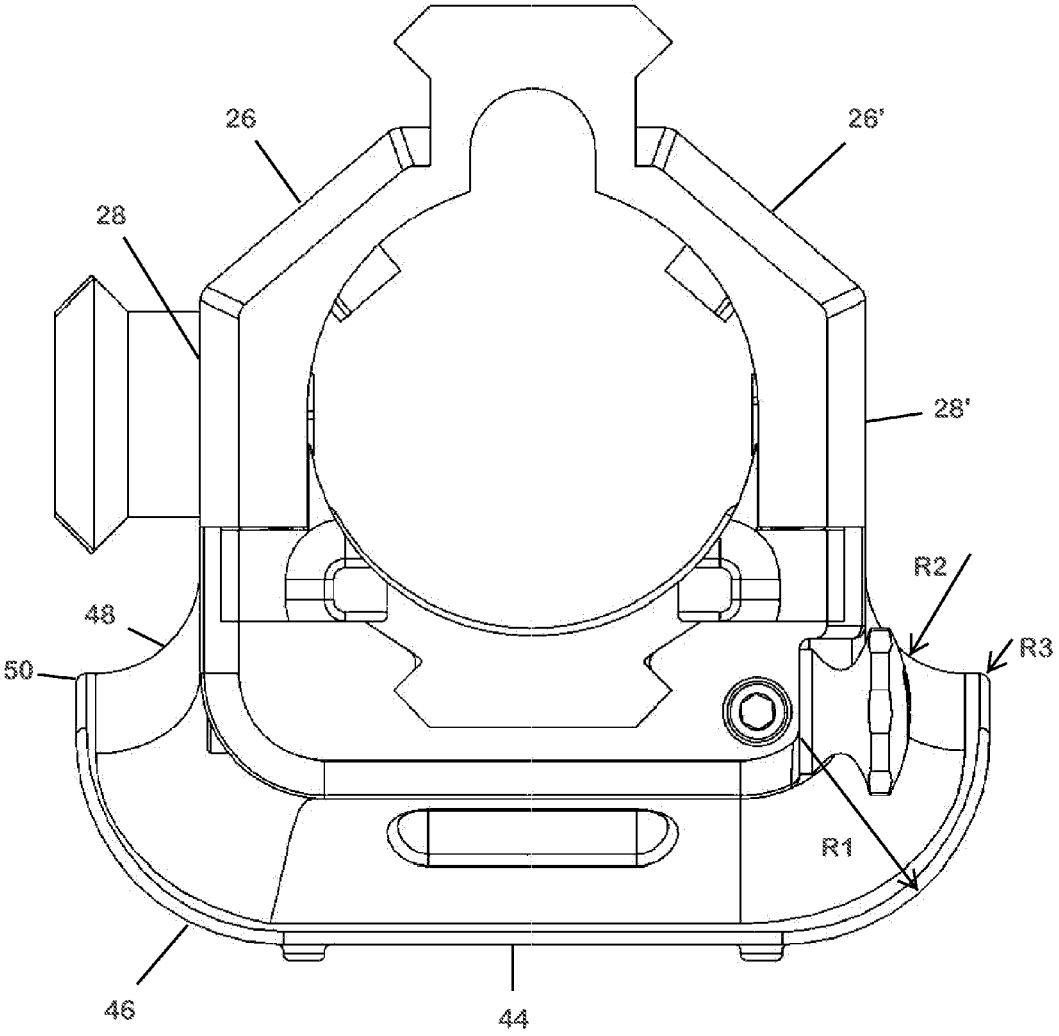
FIG. 10 is a rear elevation of the hand guard of FIGS. 6-8.

The upper metal portion 20 is made of a single piece of metal, preferably aluminum, and provides most of the structural strength of the assembly. It has an integral Picatinny rail 24 extending lengthwise along its top surface, between two oblique walls 26, 26' and two vertical side walls 28, 28' (FIG. 10). The integral rail is designed to align perfectly with the standard rail formed on the top of the AR-15's upper receiver, so the two provide a continuous surface for mounting optics and other accessories.

The outer surfaces of the oblique walls and the side walls are flat and parallel to the barrel axis. An array of holes 30 is formed in each of the oblique and vertical walls. Preferably, equally spaced holes are provided in each wall, to give the user the choice of a number of positions at which to mount auxiliary Picatinny rails. Threaded inserts 32 are permanently installed in the holes, to receive screws 33 (FIG. 7) for retaining an auxiliary or modular Picatinny rail 34. The preferred modular rails are symmetrical—so they are reversible if damaged and so they cannot be installed backwards. The modular Picatinny rails have rounded ends that allow for faster accessory changes in the field and better avoid snagging on foreign objects. The rails have flutes 35 on their back sides to ventilate the upper guard while maintaining adequate rail rigidity.

The upper metal portion has a number of slots 36 in both the oblique and vertical walls to provide good ventilation around the hot gun barrel, and to permit water, dust and other debris to drain through when necessary.

The hand grip 40 is preferably made of a moldable polymeric resin. The resin may be fiber reinforced, and is selected for qualities of strength, heat resistance and impact resistance. The presently preferred polymer is a polyamide resin such as nylon 66 or Zytel (Zytel is a trademark registered by DuPont).

The hand grip is shaped to provide a comfortable, ergonomic shape for the hand It preferably keeps the entire hand below the centerline of the barrel. The bottom 44 (FIG. 10) of the grip is flat, smooth and uninterrupted, except for a lower track described below. The flat bottom makes the grip ideal for shooting from rest positions, such as from sandbags and ledges, and prevents the grip from catching on foreign objects.

A preferred form of the grip is shown in FIGS. 6-10. The grip has, on either side of the flat bottom surface, a pair substantially quarter-round convex surfaces 46 having a first radius R1 (FIG. 10). Each convex surface is tangent to the flat bottom surface 44.

A pair of substantially quarter-round concave surfaces 48, having a second radius R2, lie above the respective convex surfaces and meet the convex surfaces at an angle of about 90°, thereby defining gripping edges 50.

Radii R1 and R2 are each between 0.5 and 1.0 inches. The gripping edge is rounded to a third radius R3 much smaller than said first and second radii, 0.125 inch at most.

Preferably, the concave and convex surfaces are substantially cylindrical, and their longitudinal axes are parallel or slightly tapering to one another and to the gun barrel.

The grip's width is at least three inches—substantially greater than that of a standard forearm—and the gripping edges 50 are well below the barrel of the rifle. That is, the gripping edges are in a common plane which does not intersect the barrel.

Although the polymer is heat resistant, to further protect it from the hot gun barrel after prolonged firing, a metal heat shield 54 (FIG. 7) is installed between the hand guard and the grip. When the shield is installed from the rear of the guard, its flanges 56 slide lengthwise into grooves 58 formed on the inner walls of the grip, and the heat shield cannot move once the grip is installed. In its installed position, the heat shield is radially spaced from both the barrel and the grip. Holes 60 in the heat shield allow ventilating air to pass and let water drain quickly if the hand guard assembly gets submerged.

A metal track 62 is molded or glued into the bottom surface of the hand grip. The track has a slot 64 which runs lengthwise and is shaped to receive standard accessories such as bipod rests: it has a slot with a "T" cross-section (FIG. 6) and is open at one end. A keyhole opening 66 near the rear of the slot admits standard mount hardware. Two common standard channels are the Aschutz-type, which has a 0.400 inch opening and the Freeland type, which has a 0.330 inch opening.

The upper guard is secured to the rifle receiver by a clamp 80 at the rear of the assembly. The clamp is drawn toward the upper guard 20 by four set screws 82 which pass upward through vertical holes 84 in the clamp. Once the screws are tightened, the upper guard is rigidly secured to the rifle's barrel nut. The clamp and its screws are concealed, normally, by the grip.

The hand guard assembly is supported only at its rear, where it is clamped to the receiver of the rifle. With this so-called "free-floating" design, the hand guard assembly does not contact the barrel of the weapon at all, and thus avoids stressing or deflecting the barrel. Moreover, this design keeps the hand guard assembly thermally isolated from the barrel. It thus provides a thermally stable mounting platform for precision accessories such as optics and lasers, and an anchoring point for slings free from the barrel. The clearance between the barrel and the hand guard assembly should be made sufficient to accommodate gas piston systems, heavy match or target barrels, and both factory and aftermarket sights.

The grip is installed by sliding it rearward onto the upper grip. The forward end of the upper guard (see FIG. 7) has two tabs 38 that extend toward one another, flush with the lower surface of the upper guard. These tabs normally seat in slots 74 formed in the sides of the grip, and hold the guard and the grip together; however, each slot is interrupted by a vertical opening 76 so that the parts can separate when the lower grip is moved forward with respect to the upper guard.

The clamp has a dovetail tenon 78 (FIG. 8) running in the longitudinal direction parallel to the barrel, and the grip has a complementary dovetail groove 80 which slides onto the tenon from the front. Thus the tabs and the dovetail joint hold the upper guard and grip together at the front and rear, respectively, when the parts are assembled.

The preferred grip is locked in its assembled position by inserting a takedown pin 82 into a horizontal transverse hole 84 in the grip. When installed, the pin also passes through a horizontal transverse groove 86 in the clamp. The takedown pin is latched in its installed position by a detent pin 88 containing a coil compression spring that biases the detent pin toward the takedown pin. The latter has a surface indentation 94 in which the detent pin seats to prevent accidental loss of the takedown pin.

The takedown pin shown may be replaced (see FIG. 9) by a pin 82' which must be turned, rather than removed, to allow the grip to slide forward. The pin can be turned with a tool, or it could have a lever affixed to its end, which would eliminate the need for a tool. This pin remains in position; it is turned approximately 90° to align a cutout in the pin while allows the lower guard to slide forward freely without frictional resistance from the lower clamp.

Figure 11:
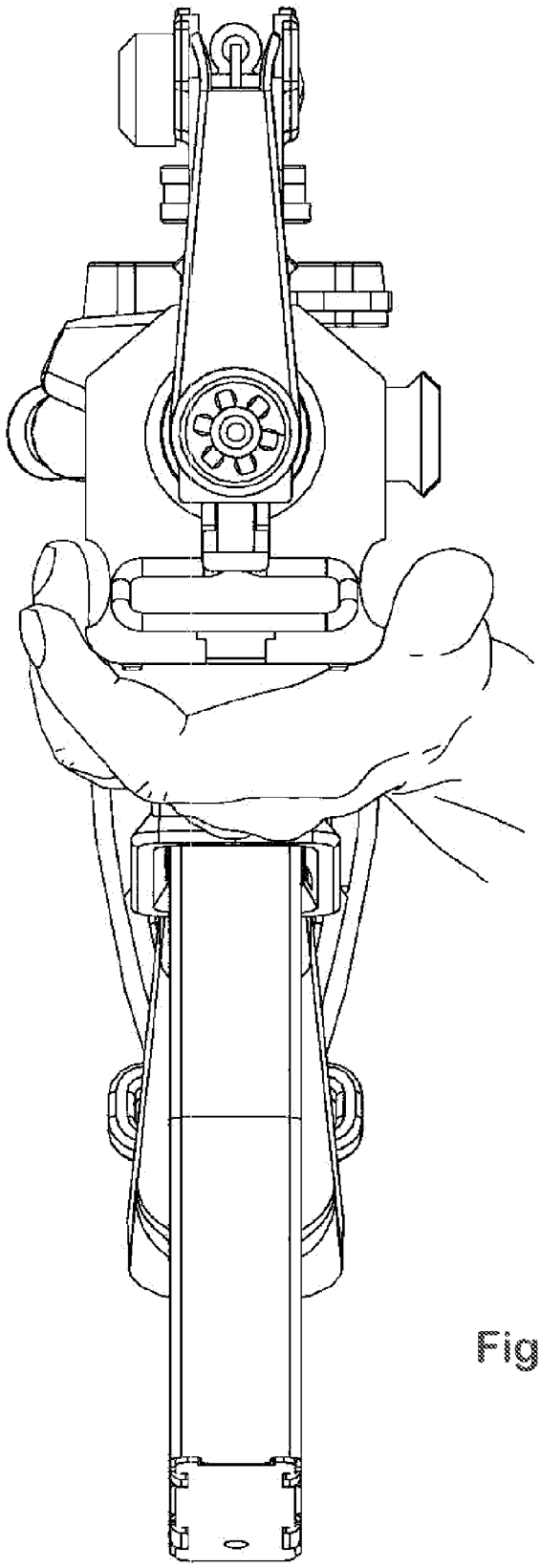
FIG. 11 is a front elevation of the hand guard of FIGS. 6-8, mounted on a rifle.
Figure 12:
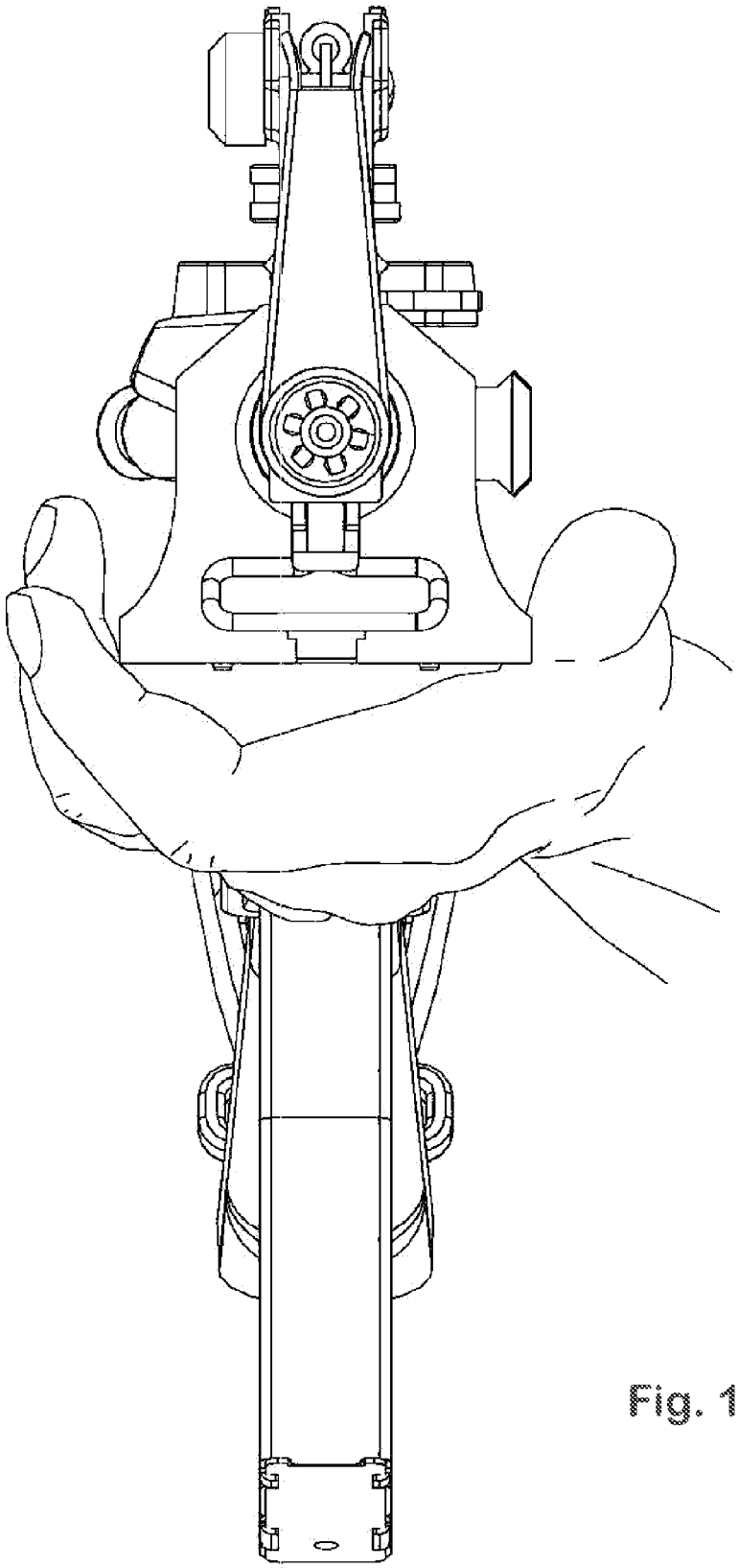
FIG. 12 is a view like FIG. 11, showing a second modified form of the invention.

FIGS. 11 and 12 show alternative grip geometries. One can see that in each case, the geometries provides gripping points below the barrel axis.

Each grip 40 may be quickly removed from the assembly without tools by removing the takedown pin; another hand guard of a different shape may be quickly substituted. The interchangeability of hand guards makes it easy and inexpensive to modify the rifle for different people, shooting stances, and situations. Therefore, a single upper guard 20 and a number of interchangeable grips may be assembled in a kit, not shown.

The invention was designed initially for AR-15 type rifles, but could be easily adapted to fit many other types of firearms.

Preferably, all the parts of the device are made of materials which are rust and corrosion resistant. While some preferences for materials of manufacture have been indicated, it should be understood that other materials may prove suitable, or even superior, and that the invention in its broadest sense is not limited to particular material selections.

Since the invention is subject to modifications and variations, it is intended that the foregoing description and the accompanying drawings shall be interpreted as only illustrative of the invention defined by the following claims.

I claim:

1. A forward hand guard assembly for a firearm having a receiver and a barrel extending along a firing axis, said assembly comprising an upper hand guard portion, a lower grip portion, and a clamp for securing a rear end of the upper hand guard and the grip to a barrel nut of the firearm so that a portion of the upper hand guard and the grip surround the barrel without contacting it, wherein the lower grip portion has a gripping surface comprising a substantially flat bottom surface, and structure for being gripped by the fingers, said structure lying entirely below the firing axis, wherein said gripping structure comprises a pair of substantially quarter-round convex surfaces having a first radius, said convex surface being tangent to the flat bottom surface, one on either side thereof, and a pair of substantially quarter-round concave surfaces having a second radius, said concave surfaces lying above said convex surfaces and meeting said convex surfaces at an angle thereby defining a gripping edge for the thumb and fingers of a shooter.

2. The invention of claim 1, wherein said concave and convex surfaces meet at an angle of about 90°.

3. The invention of claim 1, wherein said concave and convex surfaces are substantially cylindrical, each having a longitudinal axis.

4. The invention of claim 3, wherein said longitudinal axes are parallel or taper toward one another.

5. The invention of claim 3, wherein said longitudinal axes are parallel to or taper toward the firing axis.

6. The invention of claim 1, wherein said first radius is in the range of 0.5 inch to 1.0 inch.

7. The invention of claim 1, wherein said second radius is in the range of 0.5 inch to 1.0 inch.

8. The invention of claim 1, wherein the gripping edges are rounded to a third radius of not more than 0.125 inch.

9. The invention of claim 1, wherein the grip has a width of at least 2.5 inches.

10. The invention of claim 1, wherein the upper hand guard is made of a metal and the grip is made of a polymeric resin.

11. The invention of claim 1, wherein the upper hand guard has an integral Picatinny rail formed thereon.

12. The invention of claim 11, wherein the upper hand guard has walls extending from either side of said Picatinny rail.

13. The invention of claim 12, wherein said walls have flat outer surfaces on which accessories may be mounted.

14. The invention of claim 13, further comprising at least one modular Picatinny rail and fasteners for securing the modular Picatinny rail to at least one of said flat surfaces.

15. The invention of claim 1, further comprising a heat shield between the grip and the barrel of the firearm.

16. The invention of claim 15, wherein the heat shield is perforated so that fluids can pass through the shield, while allowing air to circulated around the barrel to increase barrel cooling.

17. The invention of claim 1, wherein the clamp comprises a semicircular shell shaped to engage the barrel nut and fasteners for drawing the clamp toward the upper hand guard as it engages the top of the receiver.

18. The invention of claim 1, further comprising a reinforcing metal channel member embedded in the grip and flush with the bottom surface thereof, said channel member running lengthwise of the upper hand guard and having a T-section slot with a keyhole opening for receiving mounting elements for auxiliary supports and accessories.

19. The invention of claim 1, wherein the grip has connecting structures at its front and rear ends which are engaged and disengaged with complementary structures on the upper hand guard and the clamp, respectively, by sliding the grip lengthwise relative to the upper hand guard.

20. The invention of claim 19, further comprising a pin which may be inserted through portions of both the upper hand guard and the grip, to prevent them from being moved lengthwise and thereby disconnected.

21. The invention of claim 20, further comprising a spring detent mechanism to prevent inadvertent withdrawal of the pin.

22. The invention of claim 19, wherein the connecting structure at the front end of the grip is a pair of slots extending lengthwise in the grip at its forward end, and the complementary structure on the upper hand guard is a pair of tabs which are slidably received in the slots.

23. The invention of claim 22, wherein upwardly open gaps are formed in the grip above the slots, to permit the tabs to enter the slots as the upper hand guard and grip are brought together.

24. The invention of claim 19, wherein the connecting structure at the rear end of the grip is a dovetail groove, and the complementary structure on the clamp is a dovetail tenon which engages the dovetail groove when the upper hand guard and the grip are assembled.

* * * * *